US007131479B1

(12) United States Patent
Marusak et al.

(10) Patent No.: US 7,131,479 B1
(45) Date of Patent: Nov. 7, 2006

(54) WINDOW COVERING HAVING INDICATOR MARKINGS

(75) Inventors: Thomas J. Marusak, Loudonville, NY (US); Jennifer M. Vanpoortfliet, Troy, NY (US)

(73) Assignee: Comfortex Corporation, Watervliet, NY (US)

( * ) Notice: Subject to any disclaimer, the term of this patent is extended or adjusted under 35 U.S.C. 154(b) by 224 days.

(21) Appl. No.: 10/740,339

(22) Filed: Dec. 18, 2003

Related U.S. Application Data

(60) Provisional application No. 60/435,380, filed on Dec. 20, 2002.

(51) Int. Cl.
*E06B 3/48* (2006.01)

(52) U.S. Cl. ..... 160/84.05; 160/10; 226/45

(58) Field of Classification Search ..... 160/84.04, 160/84.05, 10; 226/45; 156/378, 474
See application file for complete search history.

(56) References Cited

U.S. PATENT DOCUMENTS 4,307,768 A 12/1981 Anderson
4,984,617 A 1/1991 Corey
5,135,461 A * 8/1992 Corey et al. ..... 493/7
5,220,136 A 6/1993 Kent
5,334,421 A 8/1994 McNutt
5,336,530 A 8/1994 Ikemoto
5,395,465 A 3/1995 Miura
6,159,327 A * 12/2000 Forkert ..... 156/264
2001/0022035 A1 * 9/2001 Veloce ..... 33/758

OTHER PUBLICATIONS

Statement of public use of pertinent article prior to present invention, as described in the "Remarks" section of the response of Apr. 12, 2006.*

* cited by examiner

*Primary Examiner*—Blair M. Johnson
(74) *Attorney, Agent, or Firm*—Rader, Fishman & Grauer PLLC

(57) ABSTRACT

A covering material for a window covering assembly is provided that includes a plurality of formations, wherein an indicator marking is placed on the covering assembly at a known increment of the formations. The method of making the covering material includes, providing a web of material, printing a plurality of stripes on the web, and folding the web to create a window covering material having a plurality of formations. In one embodiment, the stripes are positioned such that a first face of the window covering material exhibits a color different than the remainder of the window covering material once folded. A longer stripe extends away from the first face to create the indicator marking. In another embodiment, the markings are made with a selectively observable material so that the covering material must be placed in a particular light to be viewed.

8 Claims, 4 Drawing Sheets

WINDOW COVERING HAVING INDICATOR MARKINGS

CROSS REFERENCE TO RELATED APPLICATIONS

This application claims priority to U.S. provisional application 60/435,380 filed on Dec. 20, 2002, which is incorporated herein by reference in its entirety.

FIELD OF THE INVENTION

The present invention relates generally to a window covering material having unique indicator markings for counting cells of the window covering material.

BACKGROUND OF THE INVENTION

One type of window covering assembly includes a plurality of horizontally extending folds, or creases, formed on a face of a window covering material. These folds serve an aesthetic function, as well as corresponding to horizontally extending air pockets, or cells, in the window covering material. This type of window covering assembly offers a number of advantages, such as insulation, sound dampening and image distortion.

The desired number of cells in the window covering material varies depending on the dimensions of the window to be covered. Consequently, one of the steps in fabricating the window covering assembly requires counting the cells in the window covering material. Hand counting each of the cells without specialized equipment is time consuming and often inaccurate.

It is known to estimate the number of cells in the window covering material by measuring a dimension of the window covering material. This method is often ineffective because the number of cells will vary depending on the compression of the material. Attempting to expand the material or compress the material prior to measurement has proven ineffective in providing an accurate count of the cells. Further, it is particularly important to have an accurate counting of cells in window covering material used to cover adjacent windows. If the number of cells of adjacent window covering materials do not match, the appearance will not be aesthetically pleasing.

SUMMARY OF THE INVENTION

In accordance with the present invention, an improved window covering material is provided with unique indicator markings for counting cells in the window covering material. In combination with this window covering material, a method and equipment for making the indicator markings is provided. In one embodiment, the window covering material, which is used to form a portion of a window covering assembly, is marked with indicator markings having the same color as a face of the window covering material. In another embodiment, the window covering material includes indicator markings printed with ultraviolet ink, so that the covering material must be placed under ultraviolet light to view the indicator markings.

During the manufacturing process, indicator markings are placed on a known increment of cells on the window covering material so that the cells are quickly and accurately counted. The same apparatus used for coloring the covering assembly material can also be configured to produce the indicator markings. In an embodiment of the present inventions drum-shaped print screens are used to color a portion of the window covering material. The print screens print a predetermined number of colored stripes each revolution, wherein at least one of the stripes is longer than the others. Alternatively, the covering material can be printed with an ultraviolet ink in place of or in combination with the colored ink used to print the stripes. Once the window covering material is folded, the longer colored stripes and/or the ultraviolet stripes form indicator markings, which can be viewed and counted.

These and other features of the present invention can be best understood from the following specification and drawings, of which the following is a brief description.

DESCRIPTION OF THE PREFERRED EMBODIMENTS

Figure 1:
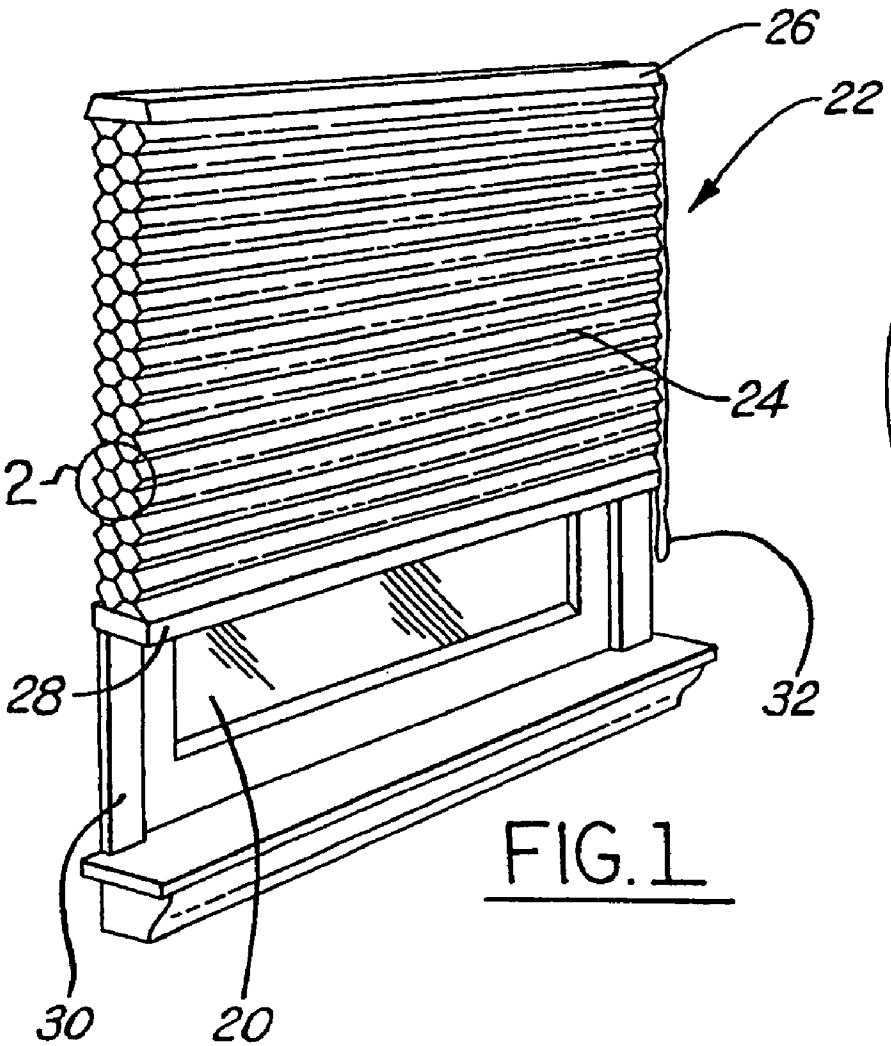
FIG. 1 is a perspective view of a window covering assembly according to the present invention.

Referring now to the drawings, wherein like reference numerals refer to like elements throughout the several figures, FIG. 1 illustrates a perspective view of a window 20 and a window covering assembly 22 which has been manufactured in accordance with the method and apparatus of the present invention.

Window covering assembly 22 includes a covering material 24, a head rail 26 and a bottom rail 28. In a preferred embodiment, covering material 24 is a double honeycomb configuration that is formed of a pliable, non-woven material. The covering material, however, may be any material having a plurality of substantially identical formations, such as folds, pleats or cells, which must be counted when fabricating the window covering assembly 22 for a particular window 20. For example, the window covering material may include a simple pleated pattern, or may be a single honeycomb cell pattern, or a triple honeycomb cell pattern.

One end of covering material 24 is supported by head rail 26, while the other end of covering material 24 is secured to bottom rail 28. Head rail 26 is attached to a frame 30 of window 20. An adjustment cord 32 extends from head rail 26 for raising and lowering bottom rail 28. When bottom rail 28 is raised to expose window 20, the accordion-like covering material 24 is compressed.

Figure 2:
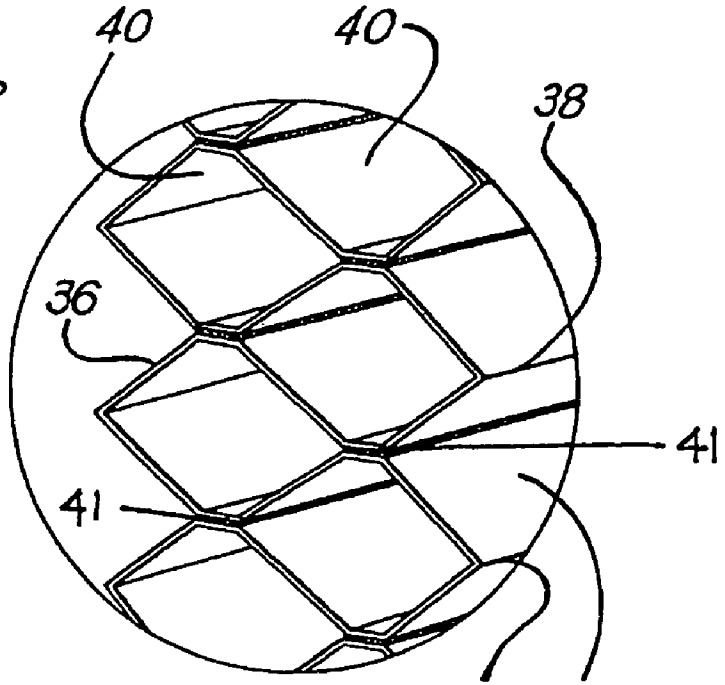
FIG. 2 is an enlarged, partial view of the window covering material as indicated in FIG. 1.

FIG. 2 is an enlarged view of covering material 24 illustrating the honeycomb configuration. Covering material 24 includes a front face 34, a rear face 36 and opposing lateral edges. Each face 34 and 36 includes a plurality of folds 38, which are also referred to as pleats or creases. In an exemplary embodiment, each fold 38 on one face of covering material 24 represents two horizontally extending air pockets or cells 40. Once folded, vertically adjacent cells 40 are affixed along at least one horizontally extending glue line 41. Thus, cover material 24 can be made from one continuous sheet of material folded upon itself to form the horizontally extending cells 40. The use of covering material 24 having cells 40 offers numerous advantages, such as insulation, sound dampening and image distortion.

Window covering assembly 22 is fabricated to specific dimensions depending upon the width and length of the window 20 to be covered. In some situations, more or less folds 38 may be desired depending on personal preference. For clarification, width will correspond to the horizontal dimension of window covering assembly 22, while the length will correspond to vertical dimension. The width of covering material 24 is easily measured and cut from an original, large sheet of material. The length of covering material 24, however, can not simply be measured. Instead, the number of cells 40 must be counted before covering material 24 is cut to the proper length because the desired number of cells 40 varies depending on the dimensions of the window 20 to be covered.

In an embodiment of the invention, the front face 34 of covering material 24 is decoratively colored to match the decor of the room that window covering assembly 22 is installed in. Because window covering 24 is made from one continuous sheet of material, it is possible to color only the front face 34 by coloring discrete portions of the material. During manufacture, these colored portions resemble stripes that are printed across the width of the covering material 24. Once folded into cells 40, the striped portions of the covering material become the cells that form the front face of covering material 24, as shown in FIG. 3.

Figure 3:
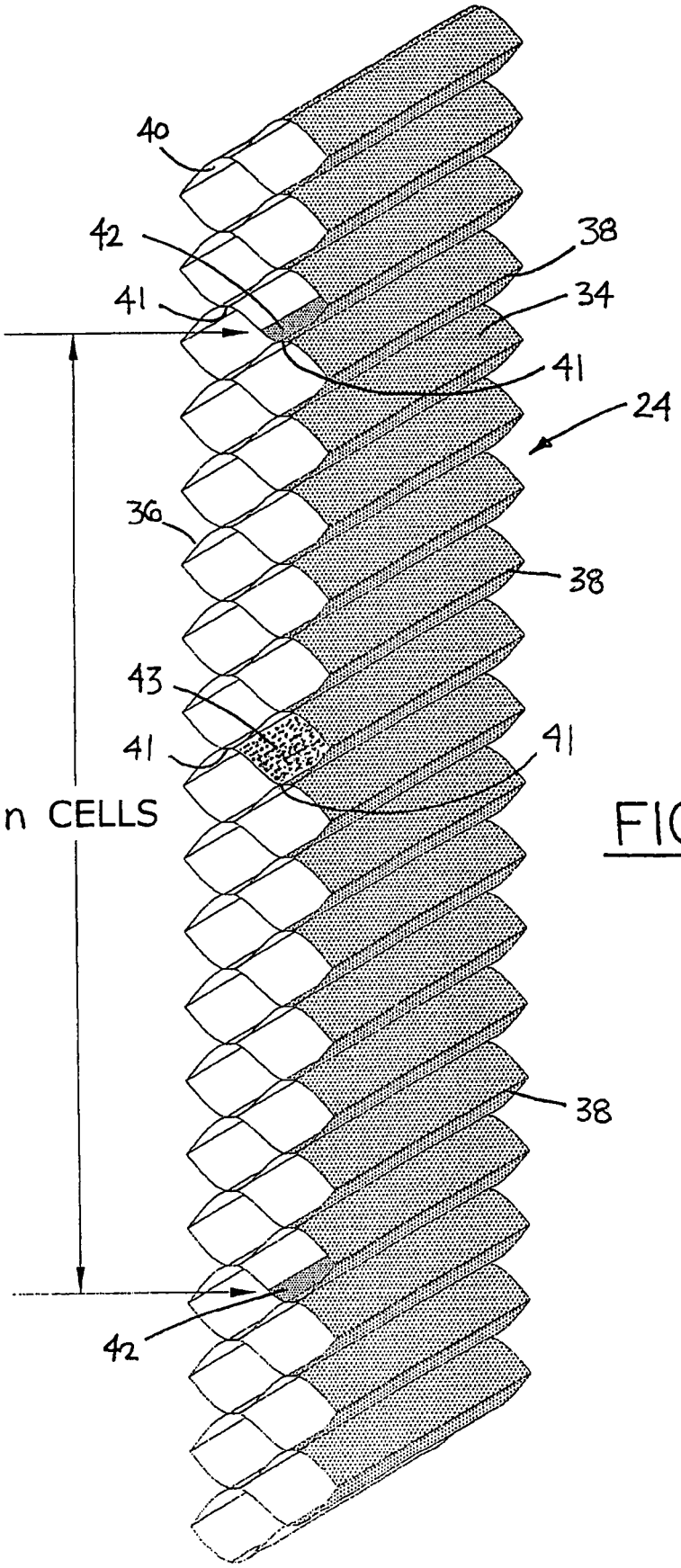
FIG. 3 is a perspective view of the window covering material in the extended position showing the indicator markings.
Figure 4:
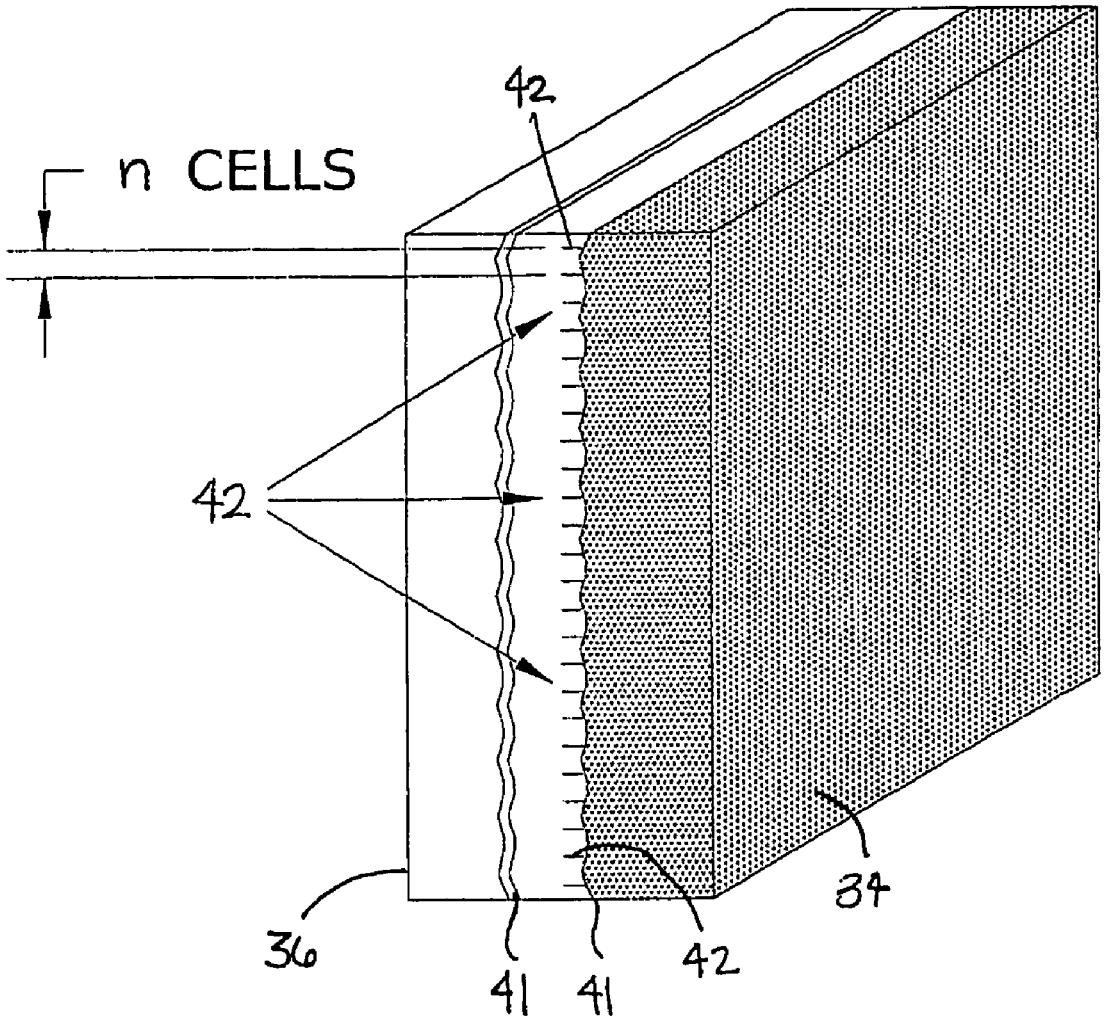
FIG. 4 is a perspective view of the window covering material in the compressed position showing the indicator markings.

FIGS. 3 and 4 also illustrate a plurality of indicator markings 42 on covering material 24, which are visible when viewing cover material 24 from the side. In an embodiment, indicator markings 42 are formed by periodically printing an extra long stripe on the covering material during manufacture. The term "long" refers to the dimension of the stripe along the length of the covering material 24. When covering material 24 is folded, the extra long stripe extends beyond the glue line 41 in the forward cells toward the glue line 41 in the rearward cells.

When covering material 24 is expanded, as shown in FIG. 3, the cells that include an indicator marking 42 are clearly visible and distinguishable from the adjacent cells. Similarly, when covering material 24 is collapsed or tightly compressed, as shown FIG. 4, the indicator markings 42 are clearly visible and distinguishable from the colored front face 34 and the remaining covering material 24. The indicator markings would also be observable on the remnant material, irrespective of how the window covering material was cut for use in window covering assembly 22. However, indicator markings 42 are not visible when covering material 24 is viewed from the front or back.

Alternatively, the covering material can be printed with a selectively observable material, such as ultraviolet ink, in place of or in combination with the colored ink used to print the stripes. An exemplary material is an optical brightener known as Alto White P-1125 made by Bolger Ohearn Company. A selectively observable material, such as ultraviolet ink, is particularly useful when the covering material is a uniform color. The covering material is placed under a particular light, such as ultraviolet light, to view the indicator markings during manufacture of window covering assembly 22.

As will be appreciated, indicator markings 42 can be spaced at known increments, each increment including a predetermined number (n) of cells 40. For example, every tenth stripe may be printed extra long so that every tenth cell includes an indicator marking 42. During manufacture, a person fabricating window covering assembly 22 can easily, quickly and reliably count the indicator markings 42 instead of counting each individual cell 40.

In some situations, a second set of indicator markings 43 at another increment may be desired. Indicator markings 43 (see, e.g., FIG. 3) may be formed by printing the indicator marker stripe even longer than the stripe used to produce indicator marker 42, so that indicator marking 43 extends farther toward the glue line 41 in the rearward cells than indicator markings 42. For example, every twentieth cell can be marked with indicator markings 43. This allows the cells to be counted at an increment larger than, or smaller than, the first increment.

As an illustration, it is assumed that a particular window covering material 24 requires one hundred and fifteen cells. A person first counts five indicator markings 43 at increments of twenty, representing one hundred cells 40. Then, the person counts one indicator marking 42 representing ten cells 40, for a total of one hundred and ten cells. Finally, the last five cells are individually counted, for the desired number of one hundred and fifteen cells. The covering material may then be cut so that the desired number of cells are provided in the covering material 24. Cells 40 may be counted in other ways using any set of markings, or a combination thereof, for the most efficient and effective counting method.

Figure 5:
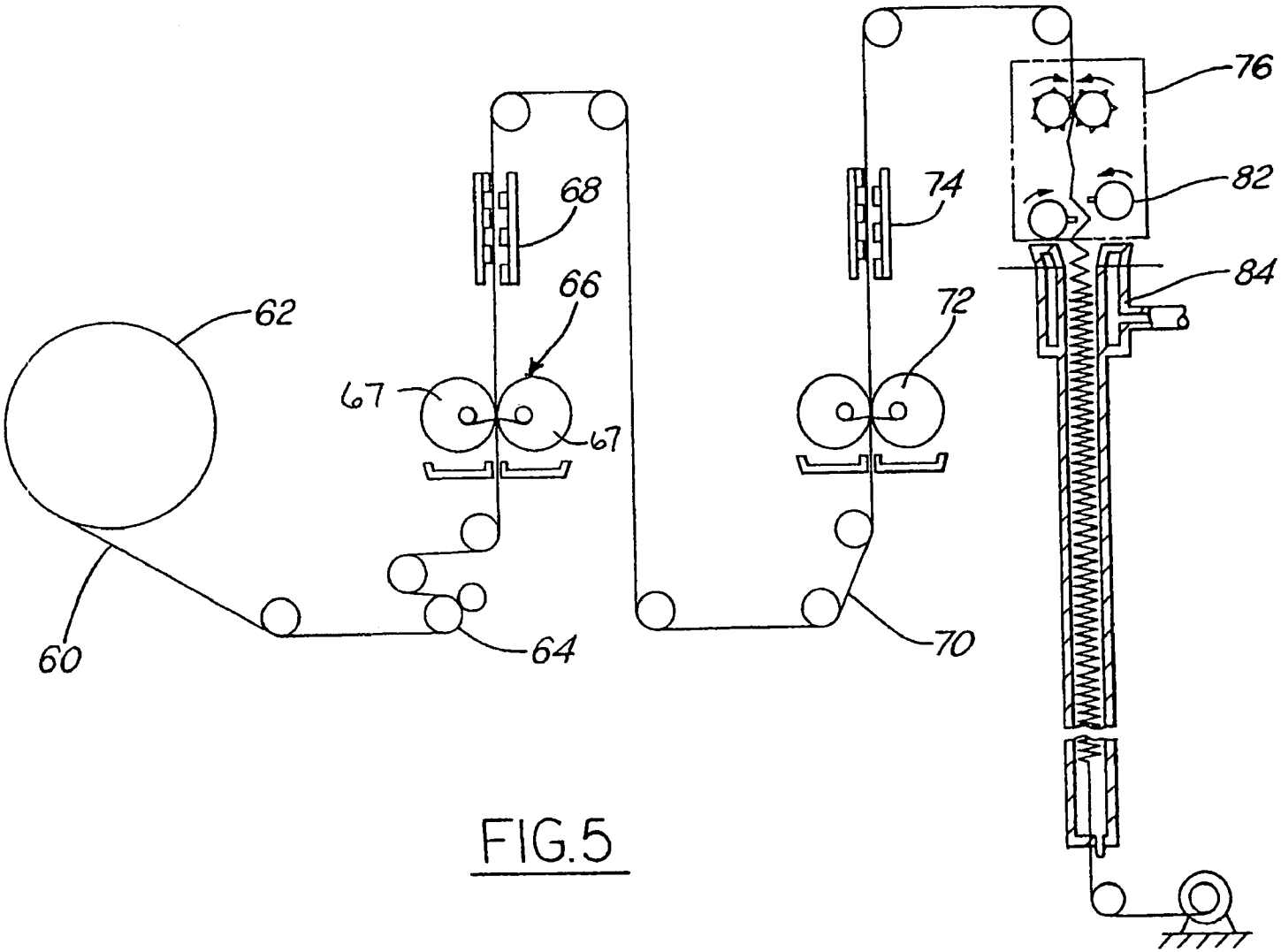
FIG. 5 is a simplified schematic view of the manufacturing process and equipment used to make the window covering material.

FIG. 5 illustrates a simplified schematic drawing of a production line for the manufacture of large sheets of covering material 24, which must later be sized and cut for a specific window. The manufacture of covering material 24 is accomplished through a combination of known techniques and equipment, such as screen printers, phase and control electronics, adhesive curing apparatus, and pleading and folding machinery. For illustration, manufacture of an embodiment of the invention will be described, which includes marking the sheet of covering material with indicator markings 42.

As shown in FIG. 5, the initial sheet of covering material 24 begins with a single continuous fabric web 60. Web 60 is unrolled from a supply reel 62 and passed through a tension station 64 in order to maintain proper tautness throughout a first screen printing station 66. First screen printing station 66 prints web 60 on the front and back with various desired colors, patterns or coatings, exclusive of adhesive. It is here that printing station 66 prints the stripes for coloring the front face 34 of window covering 24. Print station 66 includes a pair of drum-shaped print screens 67 that can print a predetermined number of stripes every revolution. In one embodiment, print screens 67 print a predetermine number of colored stripes. By printing at least one stripe longer than the others during each revolution of print screens 67, the entire web 60 is marked with extra tall stripes in predetermined increments that correspond to the desired increments between indicator markings 42 in the folded covering material 24. Print screens 67 may also be configured to print at least one stripe of a selectively observable material, such as ultraviolet ink, in place of or in combination with the colored stripes.

The next station is a curing station 68 which renders a full cure to the coatings applied at printing station 66. Web 60 then passes to a registry detection station 70 that provides adjustment in the web for deposition of an adhesive or bonding material. Thereafter, web 60 is passed into a second screen printing station 72 that coats the web with a predetermined bonding line scheme and adhesive. Subsequently, the web is passed into a drying station 74 to remove water or solvent from the adhesive. The adhesive must remain in a dried state until it can be brought into contact with the other section of the web to affect the bond lines with heat and pressure.

After drying the adhesive, pleater 76 creases the web to create folds 38. Upon exiting pleater 76, web 60 is passed into folding machinery 82, 84. After being removed from the folding machinery, the web is placed into an oven for a final thermal cure of the adhesive. After the final cure, the sheet of window covering material includes the double honeycomb structure as shown in FIG. 2.

The present invention has been particularly shown and described with reference to the foregoing embodiments, which are merely illustrative of the best modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A cellular window covering material suitable for use in a window covering assembly, the cellular window covering material comprising:

a front face, a back face and opposing lateral edges, said cellular window covering material also including a plurality of hollow collapsible cells forming at least one of said front and back faces, each cell having interior and exterior surfaces and extending from one of said lateral edges to the other of said lateral edges; and a plurality of indicator markings, each said indicator marking being on a predetermined increment of said cells on said one face, said increment being greater than two of said cells on said one face, and each said indicator marking being visible only on the interior surface of the marker-containing cells and when viewed from either of said lateral edges.

2. The window covering material of claim 1, wherein a second set of indicator markings is provided on said window covering material at a second increment, said second increment being greater than said first increment, each said indicator marking being visible only on the interior surface of the marker-containing cells and when viewed from either of said lateral edges.

3. The window covering material of claim 1, wherein said indicator markings and one of said front and back faces exhibit a color different than the remainder of said window covering material.

4. The window covering material of claim 1, wherein said indicator markings exhibit a color different than the remainder of said window covering material.

5. The window covering material of claim 1, wherein said indicator markings are made with a selectively observable material.

6. The window covering material of claim 5, wherein said selectively observable material is ultraviolet ink.

7. The window covering material of claim 1, wherein said indicator markings are viewable irrespective of how the window covering material is cut for use in the window covering assembly.

8. The window covering material of claim 1, wherein each said indicator marking extends substantially continuously from one of said lateral edges to the other of said lateral edges.

* * * * *